US005541480A

United States Patent [19]

Renardus et al.

[11] Patent Number: 5,541,480

[45] Date of Patent: Jul. 30, 1996

[54] HIGH-PRESSURE DISCHARGE LAMP WITH METAL LAYER ON OUTER SURFACE

[75] Inventors: Max L. P. Renardus, Geldrop; Henricus P. M. Gubbels, Eindhoven, both of Netherlands; Raghu Ramaiah, New York, N.Y.

[73] Assignee: U.S. Philips Corporation, New York, N.Y.

[21] Appl. No.: 448,020

[22] Filed: May 23, 1995

Related U.S. Application Data

[63] Continuation of Ser. No. 131,499, Oct. 4, 1993, abandoned.

[30] Foreign Application Priority Data

Oct. 8, 1992 [EP] European Pat. Off. ..... 92203092

[51] Int. Cl.[6] ..... H01J 61/35

[52] U.S. Cl. ..... 313/635; 313/594; 313/607

[58] Field of Search ..... 313/635, 594, 313/607, 634

[56] References Cited

U.S. PATENT DOCUMENTS 4,665,344 5/1987 Kajihara et al. ..... 313/635
4,808,876 2/1989 French et al. ..... 313/635

FOREIGN PATENT DOCUMENTS 0002848 12/1977 European Pat. Off. .
0344433 12/1989 European Pat. Off. .

*Primary Examiner*—Sandra L. O'Shea
*Assistant Examiner*—Vip Patel
*Attorney, Agent, or Firm*—Brian J. Wieghaus

[57] ABSTRACT

The invention relates to a high-pressure discharge lamp provided with a discharge vessel with a ceramic wall which has an outer surface on which a metallic coating is present. According to the invention, the coating is a metal layer sintered on the ceramic wall, which sintering process takes place during sintering of the discharge vessel so as to achieve translucence.

14 Claims, 1 Drawing Sheet

HIGH-PRESSURE DISCHARGE LAMP WITH METAL LAYER ON OUTER SURFACE

This is a continuation of application Ser. No. 08/131,499, filed on Oct. 4, 1993, now abandoned.

BACKGROUND OF THE INVENTION

The invention relates to a high-pressure discharge lamp provided with a discharge vessel with a ceramic wall which has an outer surface on which a metallic coating is present.

The invention also relates to a method of manufacturing such a lamp.

The term "ceramic wall" in the present description and claims is understood to mean a wall made of either translucent crystalline metal oxide such as, for example, monocrystalline sapphire or, for example, gastight polycrystalline aluminium oxide, or a wall of translucent gastight sintered polycrystalline AlN.

A lamp of the kind mentioned in the opening paragraph is known from EP-A-0002848. To promote lamp ignition, the outer surface of the discharge vessel of the known lamp is provided with an electrically conducting ignition strip in the form of a metallic coating. The strip is adhered to the outer surface of the wall of the discharge vessel in the form of a mixture of metal and metal-oxide particles by means of heating. A metallic coating of a portion of the outer surface of the discharge vessel wall is also known in the form of a heat shield. The aim of this is to exert a positive influence on the heat balance of the lamp. Such a coating is known from inter alia EP-A-034 4 433. The metallic coating may be vapour-deposited in vacuum or provided as a paste which is subsequently cured.

It is found that the metallic coating thus obtained often shows defects during lamp life, in the form of fractures or cracks in the coating or detaching of the coating from the ceramic wall. Such defects in an ignition strip adversely affect the ignition-promoting effect thereof. If the defects are found in a coating serving as a heat shield, they will lead to an undefined change in the heat balance of the lamp. This will generally result in undesirable changes in photometric properties (luminous efficacy, colour temperature, colour rendering) of the lamp.

SUMMARY OF THE INVENTION

The invention has for its object to provide a measure by which the occurrence of the said defects is counteracted. According to the invention, a lamp of the kind mentioned in the opening paragraph is for this purpose characterized in that the metallic coating is a metal layer sintered on the ceramic wail. It was found that sintering of a metal directly on the ceramic wail as a coating results in a well-adhering, continuous coating which is not subject to any appreciable changes during lamp life. A very suitable metal for the metallic coating is W because this combines a large number of favourable properties such as a good heat resistance, good electrical conductance, good sintering possibilities. Besides W, also Zr, Mo, Ta and Nb are highly suitable for use as metals for the metallic coating.

Preferably, a lamp according to the invention is manufactured by a method according to which the discharge vessel with ceramic wall is formed in that a coating is provided on an outer surface of a wail of a previously baked moulded piece by the application of a paste, which paste is formed by a mixture of metal powder and a solvent, and subsequently the moulded piece thus coated is dried, after which the coated moulded piece is sintered so as to achieve translucence. The paste can also include a binder.

The term "previously baked moulded piece" in the present description and claims is understood to mean a piece moulded under pressure from a powder mixture which can be sintered so as to achieve translucence, which moulded piece is then baked in such a manner that an initial sintering growth between the powder particles occurs. Advantageously, both a translucent discharge vessel and a sintered bond between the wall of the discharge vessel thus formed and the metallic coating is realised in a single sintering process by the method according to the invention.

It has indeed been suggested in the literature to sinter W on a base surface of $Al_2O_3$. It is stated there that the addition of 3% up to even 10% of $ZrO_2$ or $ZrO_2$ and $SiO_2$ to the otherwise pure $Al_2O_3$, is essential for achieving a good sintering bond between $Al_2O_3$ and W. To obtain translucent $Al_2O_3$, on the one hand the addition of quantities as mentioned above was found to be absolutely unsuitable, while on the other hand MgO as a sintering dopant is indispensable for achieving a density of the sintered $Al_2O_3$ required for satisfactory translucence.

The invention results in a lamp which is more robust than the known lamp and which is easier to manufacture. Also compared with lamps which are much used in practice and which are provided with separate ignition antennas in the form of a wire which is either coiled around the discharge vessel or tensioned alongside the discharge vessel, the lamp according to the invention is much more robust while the manufacture of the lamp according to the invention is much simpler.

BRIEF DESCRIPTION OF THE DRAWINGS

Aspects of the invention as described above as well as other aspects are explained in more detail below with reference to a drawing in which.

DESCRIPTION OF THE PREFERRED EMBODIMENTS

Figure 1:
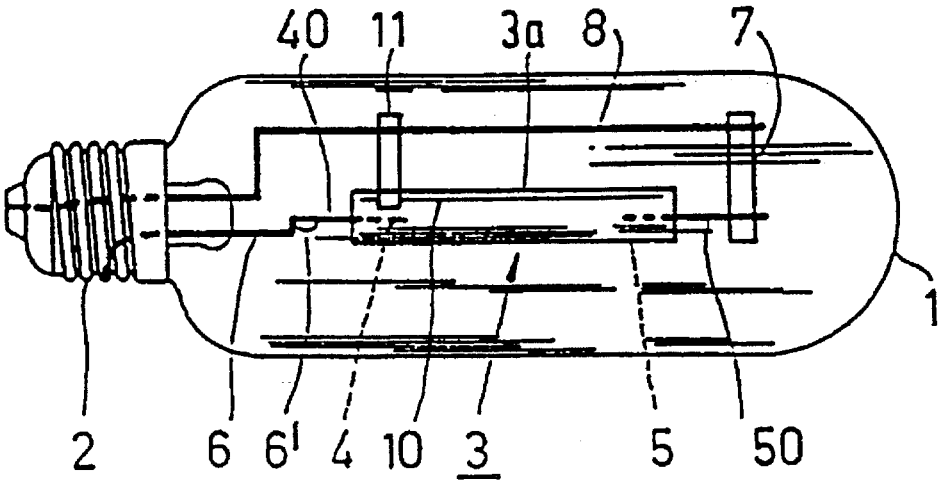
FIG. 1 shows a lamp according to the invention and FIG. 2 shows a discharge vessel according to an alternative embodiment.

In FIG. 1, a high-pressure sodium lamp according to the invention is provided with a discharge vessel 3 with a ceramic wall 3*a* in which at least Na as an ionizable filling component and a rare gas are present. The discharge vessel encloses a discharge space. The lamp is provided with main electrodes 4, 5 which are arranged in the discharge space and between which a discharge takes place in the operational condition of the lamp. The main electrodes 4, 5 are each connected to a respective current lead-through member 40, 50, which is passed through the wall 3*a* of the discharge vessel 3 and is connected thereto in a gastight manner by means of a connection of a ceramic sealing compound. The lamp is also provided with an outer bulb 1 and a lamp cap 2. The lead-through member 40 is electrically connected to a rigid current conductor 6, which is internally connected to the lamp cap 2, via a flexible conductor 6'. The lead-through member 50 is electrically and mechanically connected to a rigid current conductor 8, which is also internally connected to the lamp cap 2, via an auxiliary conductor 7.

A metallic coating in the form of a metal layer 10 sintered on the ceramic wall is present on the outer surface of the ceramic wall 3*a* . The metal layer serves as an ignition aid and extends substantially between the main electrodes 4, 5. When the lamp is not operating, an end of a bimetal element 11 rests against the metal layer 10 near the main electrode 4. The bimetal element 11 is fastened with another end to the current conductor 8. When the lamp is operating, the heat generated by the discharge breaks the contact between the metal layer 10 and the bimetal element 11 by bending away the bimetal element 11.

In an advantageous practical embodiment of a lamp as described, the ceramic discharge vessel is provided with a wall formed from translucent, densely sintered polycrystalline $Al_2O_3$ on which a coating of W is present. The discharge vessel was preferably formed during manufacture of the lamp by the advantageous method to be described in detail below. Starting in usual manner from a powder mixture of $Al_2O_3$ with at most 1000 ppm MgO, a moulded piece is made under pressure which is subsequently pre-baked in the air at a temperature of 1200° C.

A coating is then provided on the moulded piece thus obtained through the application of a paste formed by a mixture of W-powder and a solvent. A suitable solvent is terpineol. The paste may in addition contain a binder, for example, ethyl cellulose. A large number of industrially applicable methods is available for applying the coating, such as, for example, painting, writing, tampon printing, ink-jet printing, dispensing, roller coating.

The moulded piece thus coated is subsequently dried, whereby the solvent substantially evaporates. It was found with the use of terpineol that heating for approximately 30 minutes at 175° C. results in evaporation of more than 95% of the terpineol originally present. If a binder is present in the paste, it is then baked out. With ethyl cellulose as the binder, it was found that heating for approximately 30 minutes in a dry atmosphere of 7 vol % $H_2$ and 93 vol % $N_2$ leads to a substantially complete firing away/combustion of the binder present.

After drying and baking, the moulded piece is sintered so as to achieve translucence. This is done in a manner known per se through heating in an atmosphere of moist hydrogen at approximately 1950° C. for approximately 2 hours. Sintering between $Al_2O_3$ and the W of the coating takes place simultaneously with sintering of the $Al_2O_3$ to achieve the translucent state.

In addition to MgO as the sintering dopant in the basic material for the manufacture of the discharge vessel, extra additions, albeit in small quantities up to approximately 500 ppm, were found useful in practice, such as $Er_2O_3$, $Y_2O_3$ and $ZrO_2$. The temperature and time required for sintering to achieve translucence are influenced to some extent by such extra additions. The use of $SiO_2$ is known to be unsuitable as an additive when a good translucence of the sintered product is required.

In the embodiment described, W-powder with a particle size distribution of between 0.2 μm and 1 μm was used, with an average value of 0.4 μm, which corresponds to the particle size distribution of the $Al_2O_3$ powder usual in practice.

Inspection of discharge tubes manufactured by the method described shows that $Al_2O_3$ crystals have assumed a different surface structure at the area of the coating compared with that which is present and usual at the exposed surface of the ceramic wall of the discharge vessel. The surface structure at the area of the coating has a crystal size distribution which is comparable to the size and pore structure of the W-particles.

High-pressure sodium lamps with a power rating of 400 W were manufactured from the discharge tubes made by the method described above in a manner which was conventional in all further respects. The filling of the discharge vessel contains excess Na amalgam in a weight ratio Na/Hg of 9/40 and Xe with a pressure of 40 kPa at room temperature. The ignition strip has a width of approximately 0,5 mm and a thickness which varies between 30 μm and 50 μm, resulting in a luminous decrement of less than 3%. After a lamp life of 100 hours, the average ignition voltage is 2350 V, and after a life of 1000 hours it is 2425 V. For comparison it should be noted that production lamps of the same power rating and the same filling in the discharge vessel, provided with an external loose antenna as an ignition aid have an average ignition voltage of 2400 V after 100 hours of lamp life, and 2650 V after 1000 hours of lamp life.

In an alternative embodiment of the lamp according to the invention, the ignition strip is arranged so as to be electrically floating. The discharge vessel is pictured in FIG. 2, components corresponding to those of FIG. 1 having the same reference numerals.

The discharge vessel 3 is provided with an ignition strip 10 which is provided with a transverse strip 11, 12 at either end at the level of the respective main electrode. Each of the transverse strips 11, 12 forms a substantially closed ring.

Figure 2:
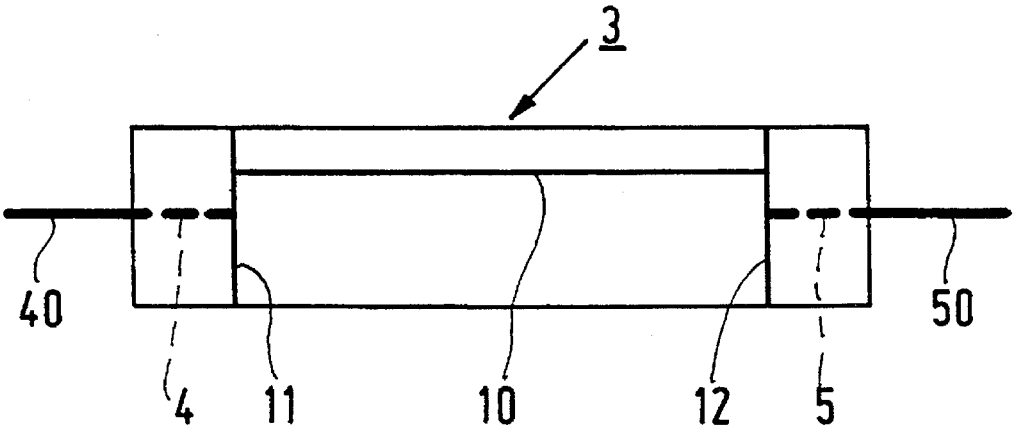

High-pressure sodium lamps were manufactured from the discharge tubes according to FIG. 2, which were manufactured by the method described above, in an otherwise conventional manner. In a first instance, these were lamps with a power rating of 400 W, provided with a filling of the discharge vessel comprising an excess quantity of sodium amalgam in a weight ratio Na/Hg of 9/40 and Xe with a pressure of 40 kPa at room temperature. The ignition strip has a width of 0.5 mm, as do the transverse strips. The average ignition voltage is 2625 V. According to IES standards, an ignition voltage of 2800 V is admissible.

In a second instance, the power rating of the lamp was 70 W and the pressure at room temperature of the Xe was 26 kPa. The ignition strip in this case is 0.16 mm wide. The average ignition voltage is 1730 V against the IES standard according to which 1800 V is admissible.

The luminous efficacy is 96 lm/W, which is a loss of 1.5% compared with similar lamps provided with ignition antennae which deflect away.

We claim:

1. A high-pressure discharge lamp, comprising:

a discharge vessel with a ceramic wall which has an outer surface, the outer surface having a crystal size and pore distribution; and a metal layer sintered on and having a sintered bond with the outer surface of the ceramic wall, the metal layer having a particle size and pore distribution comparable to the crystal size and pore distribution of the outer surface of the ceramic wall at the location of the metal layer, and the crystal size and pore distribution of the outer surface of the ceramic wall being different at the location of the metal layer than at portions not having the metal layer.

2. A high pressure discharge lamp according to claim 1, wherein said metal layer is a strip extending along the length dimension of said discharge vessel to facilitate ignition of a discharge within said discharge vessel.

3. A high pressure discharge lamp according to claim 2, wherein said discharge vessel includes a pair of opposing discharge electrodes each at an opposing respective end thereof, and said metal layer further includes a substantially closed circumferential ring extending at the axial location of each electrode and in contact with said strip.

4. A high pressure discharge lamp according to claim 3, wherein said medal layer comprising said strip and said two rings is electrically floating.

5. A high pressure discharge lamp according to claim 1, wherein said metal of said metal layer is selected from the group consisting of W, Zr, Mo, Ta and Nb.

6. A high pressure discharge lamp according to claim 5, wherein said discharge vessel consists essentially of $Al_2O_3$ and is essentially free of $ZrO_2$ and $SiO_2$.

7. A high pressure discharge lamp according to claim 6, wherein said discharge vessel includes a dopant in quantities up to approximately 500 ppm selected from the group consisting of $M_gO$, $Er_2O_3$, $Y_2O_3$, and $SiO_2$.

8. A high pressure discharge lamp, comprising:

a discharge vessel with a ceramic wall having an outer surface, the outer surface having a crystal size and pore distribution; and a metal layer sintered on the outer surface of said ceramic wall, said sintered metal layer being formed by (i) applying a paste comprised of a mixture of metal powder and a solvent to the ceramic discharge vessel in a previously baked molded state of the discharge vessel in which only initial sintering growth between ceramic powder particles of the discharge vessel exists, and (ii) sintering the discharge vessel with said paste thereon to achieve translucence of the ceramic discharge vessel and a sintered bond of said metal layer with said outer surface, said metal layer having a particle size and pore distribution comparable to the crystal size and pore distribution of the outer surface of the ceramic wall at the location of the metal layer, and the crystal size and pore distribution of the outer surface of the ceramic wall being different at the location of the metal layer than at portions not having the metal layer.

9. A high pressure discharge lamp according to claim 8, wherein said metal layer is a strip extending along the length dimension of said discharge vessel to facilitate ignition of a discharge within said arc tube.

10. A high pressure discharge lamp according to claim 9, wherein said discharge vessel includes a pair of opposing discharge electrodes each at an opposing respective end thereof, and said metal layer further includes a substantially closed circumferential ring extending at the axial location of each electrode and in contact with said strip.

11. A high pressure discharge lamp according to claim 10, wherein said metal layer comprising said strip and said two rings is electrically floating.

12. A high pressure discharge lamp according to claim 8, wherein said metal of said metal layer is selected from the group consisting of W, Zr, Mo, Ta and Nb.

13. A high pressure discharge lamp according to claim 12, wherein said discharge vessel consists essentially of $Al_2O_3$ and is essentially free of $ZrO_2$ and $SiO_2$.

14. A high pressure discharge lamp according to claim 13, wherein said discharge vessel includes a dopant in quantities up to approximately 500 ppm selected from the group consisting of $M_gO$, $Er_2O_3$, $Y_2O_3$ and $SiO_2$.

* * * * *